US005309575A

United States Patent [19]

Lookhoof

[11] Patent Number: 5,309,575

[45] Date of Patent: May 10, 1994

[54] BELT WITH MUTUALLY ADHESIVE FABRIC MATERIAL

[76] Inventor: Nancy F. Lookhoof, 2501 Deerfoot Trail, Austin, Tex. 78704

[21] Appl. No.: 436,353

[22] Filed: Nov. 14, 1989

[51] Int. Cl.[5] ..... A41F 9/02

[52] U.S. Cl. ..... 2/322; 2/312; 2/920

[58] Field of Search ..... 2/322, 321, 311, DIG. 6, 2/300, 308, 312

[56] References Cited

U.S. PATENT DOCUMENTS

| | | | |
|---|---|---|---|
| 721,253 | 2/1903 | Thompson | 2/322 |
| 1,414,048 | 4/1922 | Schlutz | 2/322 |
| 1,543,399 | 6/1925 | Smith | 224/4 |
| 2,914,070 | 11/1959 | Kellner et al. | 128/558 |
| 3,063,118 | 11/1962 | Salter et al. | 2/322 |
| 3,501,774 | 3/1970 | Norman | 2/321 |
| 3,848,270 | 11/1974 | Rand | 2/311 |
| 3,866,276 | 2/1975 | Perkins | 2/311 |
| 4,463,455 | 8/1984 | Kirk | 2/322 |
| 4,472,839 | 9/1984 | Johansen | 2/338 |
| 4,617,685 | 10/1986 | Grandis | 2/338 |
| 4,691,460 | 9/1987 | Kohl . | |
| 4,715,839 | 12/1987 | Ford et al. . | |
| 4,782,535 | 11/1988 | Yewer, Jr. et al. | 2/321 |
| 4,819,846 | 4/1989 | Hannemann | 2/312 |
| 4,849,863 | 7/1989 | Gallegos | 2/311 |

*Primary Examiner*—William A. Cuchlinski, Jr.

*Assistant Examiner*—C. W. Fulton

[57] ABSTRACT

A belt designed for size adjustability, self-sealing closure, and temporary engagement to the waistband of skirt/slack of the wearer. The belt utilizes an outer face of fashion fabric and an inner face of fabric of mutually adhesive material with the addition of one relatively small strip of mutually adhesive material on one end of the fashion fabric and a closure strip traversely affixed to the opposite end of the fashion fabric. A continuous band is formed by engaging the small strip of mutually adhesive material to the inner fabric at any point along the circumference. The closure strip is folded around the engaged belt and then temporarily affixed to the inner fabric in c-shaped fashion by mutually adhesive material strips securely affixed to the ends of the closure strip. The inner fabric allows the belt to be temporarily secured to the skirt/slack waistband of the wearer by the addition of a relatively small strip of mutually adhesive material being applied to the center back of skirt/slack waistband to prevent the waistband from pulling down below the belt. A design variation incorporates the use of readily removable and interchangeable decorative strips color-coordinated of fabric coordinated to the garment being worn. A second variation splits the belt into two separate pieces that are then interlocked together and secured to the inner fabric of each by a small strip of mutually adhesive material securely affixed to the split ends.

9 Claims, 3 Drawing Sheets

BELT WITH MUTUALLY ADHESIVE FABRIC MATERIAL

BACKGROUND—FIELD OF INVENTION

The present invention relates to an article of clothing worn around the torso for decorative and utilitarian purposes of holding a skirt or slack in its proper place, and more specifically to an improved belt construction which enables the article to fit a wide range of sizes while permitting the wearer to neatly and precisely fit the item about the torso and to interchangeably customize the basic item for a specific garment(s).

BACKGROUND—DISCUSSION OF PRIOR ART

Belts are generally worn by females to 'complete,' 'finish-off,' and 'compliment' a garment. They are frequently very artistic and a center point of focus for the garment, but this focus is many times compromised by the skirt/slack waistband pulling down, out and away, from the would-be neat, finished look. Heretofore, decorative belts have been designed wider and wider by designers without any regard to the size of waistbands or to the utilitarian function of holding the garment in a particular place around the torso. Consequently the wider, decorative belts are worn over the waistband and even over belt loops if there are any, rendering the belt loops themselves useless in holding the waistband to the belt and therefore in place. A waistband that pulls down, out and away, from a belt that is supposed to give that complete, finished look takes that possible professional look and tosses it into the trash can thereby preventing the female from staying on the same level as her male counterpart in his pinstripe suit and neat alligator belt that stays in place and holds his pants in place. U.S. Pat. No. 721,253 to Thompson (1903) was the first to address the problem of holding a skirt in place, but since the metal 'shirt-waist retainer and conformer' was designed primarily to 'shape' the body and thus be worn as an undergarment it is hardly a decorative belt design that would be worn on top of the waistband. In any event the skirt might be held in place, but the waistband would still easily have the vertical movement whereby it would pull down away from a decorative top surface belt, a condition the applicant's design would control.

Inventors have created several different ways to obtain adjustable size belts, U.S. Pat. No. 4,715,839 to Ford et al. (1987) and U.S. Pat. No. 4,617,685 to Grandis (1985), but belt wearers want the size flexibility without the use of an elastic band or elastic strip. U.S. Pat. No. 4,472,839 to Johansen (1984) allows the flexibility without the use of elastic, but the size range is limited by the length of the mutually adhesive material affixed to the inner and outer faces that also impose an additional cost to the manufacturer or consumer.

U.S. Pat. No. 4,472,839 to Johansen (1984) did address the problem that belts with a closure of mutually adhesive material have in regards to the two engaged strips pulling away from each other and thereby not being neatly closed and secured, but Johansen's closed belt loop makes it difficult to run one belt end through the loop without the two segments engaging one another before the precise circumference is obtained.

Belts worn by females are often the focal point of a garment culminating in the need for plurality of belts of different colors and designs which inherently increase the cost of the wardrobe and storage space as well. U.S. Pat. No. 3,848,270 to Rand (1973), U.S. Pat. No. 4,691,460 to Kohl (1985), and U.S. Pat. No. 4,715,839 to Gord et al. (1987) addressed the problem and employed different mechanisms of personalizing basic belts, but they're awkward to say the least. Rand utilizes decorative strips being attached to the outer fashion fabric via snaps or mutually adhesive material affixed to both making the outer fashion fabric unwearable without the decorative strips to cover the hooking mechanism. Kohl employs a framed plaque with the elements being replaceable while Ford's et. al. is actually a belt/toy combination with a metal toy being detachable from the magnetized buckle unit.

It is understandable that belt designs heretofore have not employed the mutually adhesive material since the material is considered display fabric and is usually obtained from display businesses. The apparel industry has only utilized mutually adhesive material in strip form and is generally unaware of the wider bolt fabric that would allow the 'smooth' side of the mutually adhesive strip to be cut in a contour or other desired shape thus avoiding the limitations of the 'parallel strips' utilized in all prior art such as Johansen or U.S. Pat. No. 3,866,276 to Perkins (1975), in which instance a policeman's utilitarian belt of parallel shape would not have been limited by the strip shape. The industry is also very accustomed and attuned to relatively short strips and certainly to two matching component strips of the same approximate length. The inventor herself utilized the mutually adhesive material for display boards many years before the present invention was designed or attempted; yet the inventor has personally constructed belts for years also. There was no indication from the apparel industry that the invention would be feasible.

OBJECTS AND ADVANTAGES

Accordingly the objects and advantages of my improved belt invention discussed herein are:

a. capability to remain in the same position on the skirt/slack waistband at all times whether the user be sitting, standing or rising from the sitting position with the addition of a mutually adhesive material securely affixed to the center back waistband of a garment. This invention makes it easy for the user, or the retail outlet as a customer service, to remedy the problem;

b. the inner fabric of mutually adhesive material gives the belt invention the capability of precisely fitting a much wider range of circumferences with a mutually adhesive material being applied to only one end of the outer fashion fabric resulting in an economic savings for the manufacturer and/or consumer;

c. the inner fabric of mutually adhesive material construction technique allows the closure means to be a linear strip with mutually adhesive material affixed to each end to adhere to the inner fabric by folding down in c-shape fashion after the proper size is obtained thus making it much easier for the wearer to manipulate;

d. the inner fabric of mutually adhesive material provides an easy personalization mechanism for customizing a belt for a specific garment while utilizing the same basic belt for a consequential economic savings. A decorative strip variation and a two-part belt variation accomplish this objective. Still further objects and advantages of my improved invention will become apparent from a consideration of the drawings and ensuing description.

BRIEF DESCRIPTION OF THE DRAWINGS

In the accompanying drawings depicting the specifications, and in which like numerals are employed to designate like parts throughout the same.

DESCRIPTION—FIGS. 1 TO 10 AND THEIR OPERATION

Figure 1:
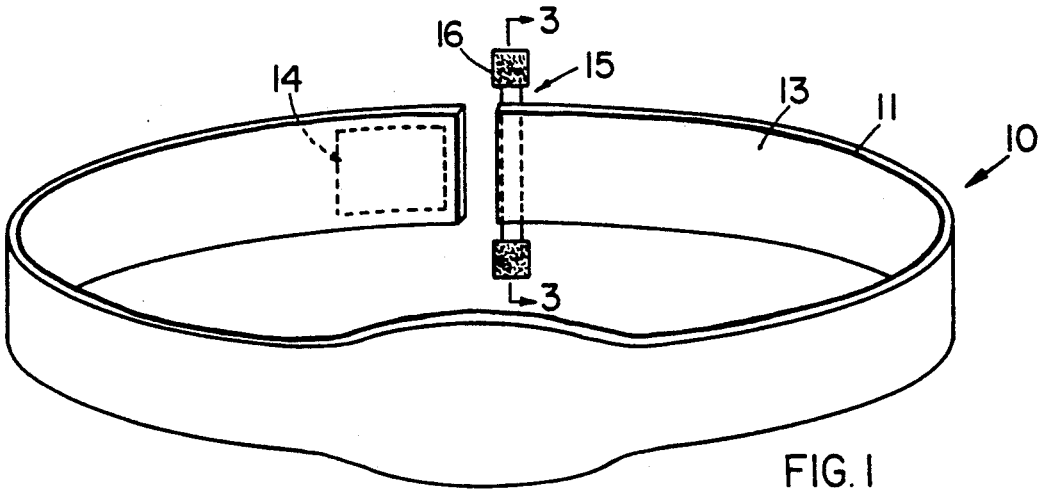
FIG. 1 is a perspective view illustrating the basic belt design concept in accordance with the present invention.
Figure 2:
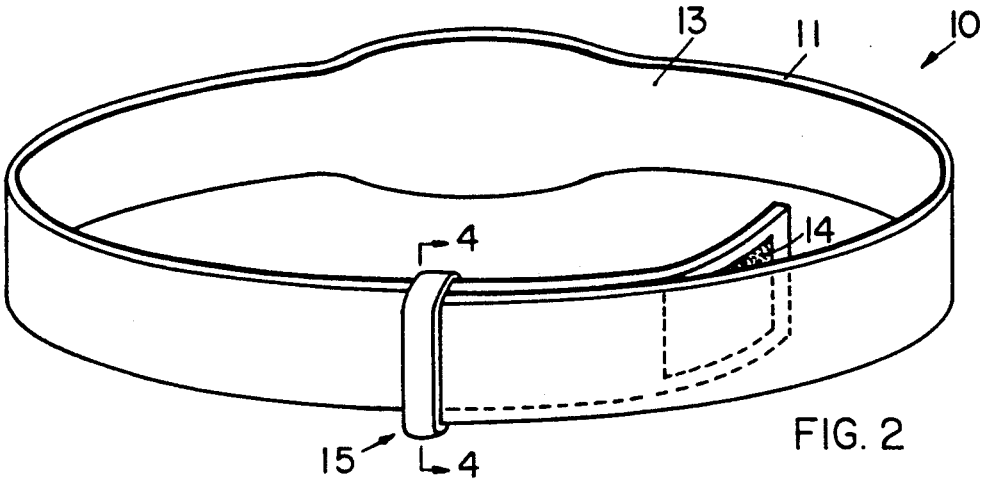
FIG. 2 is a perspective view of the basic belt design concept shown with the belt ends in their interconnected position.

A typical embodiment of the present improved belt invention is illustrated in FIG. 1 (perspective view) and FIG. 2 (perspective view with belt ends interconnected).

Referring now to the drawings and more particularly to FIG. 1, reference number 10 generally designates the belt in accordance with a presently preferred embodiment of the design with the outer face of fashion fabric 11 and the inner face of fabric of mutually adhesive material 13. A relatively short piece of mutually adhesive material 14 is securely affixed to one end of the outer fashion fabric. Typically adhesive materials of this type include one component having a surface of closely spaced looped filaments and a second material component having a surface of hook-like projections. When placed in contact position, the looped filaments engage the hook-like projections to provide a firm connection while allowing the cooperating materials to be pulled apart. The belt is wrapped around the torso of the wearer, and when the precise circumference is obtained the inner fabric of mutually adhesive material 13 is pressed to the short strip of mutually adhesive material 14 thus engaging the loops (FIG. 2).

Figure 3:
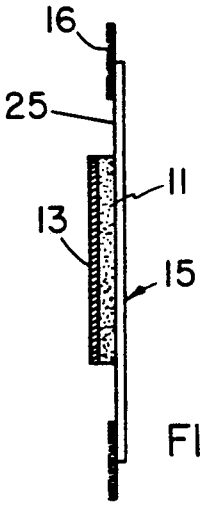
FIG. 3 is a sectional view taken on line 3—3 of FIG. 1.
Figure 4:
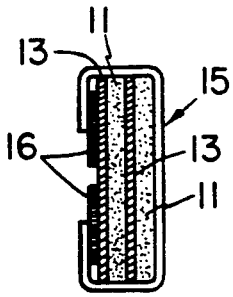
FIG. 4 is a sectional view taken on line 4—4 of FIG. 2.

The closure means 15 having a mutually adhesive material 16 affixed to the back side 25 of both ends is securely affixed transversely to the opposite outer fashion fabric end (FIG. 3). Once the belt is wrapped around the torso of the wearer in partially overlapping fashion with the inner fabric 13 being engaged with the short strip of mutually adhesive material 14, the closure means 15 is folded around the engaged belt in c-shape fashion thereby forming a partially opened loop by the mutually adhesive material 16 attached to both ends of the closure means 15 adhering to the inner fabric 13 for a self-sealing neat closure (FIG. 4).

Figure 5:
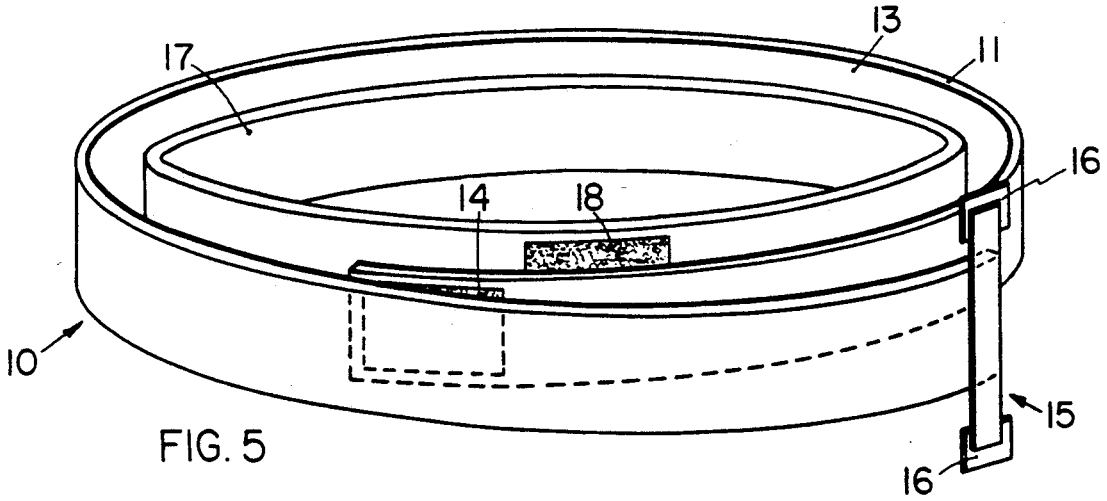
FIG. 5 is a sectional view showing the belt temporarily secured to the waistband of skirt/slacks.

The belt is then positioned on the torso of the wearer with the skirt/slack waistband 17 being pulled up and under the belt. When the waistband and the belt are in the correct position, the inner fabric 13 is pressed to the garment's center back mutually adhesive material 18 (FIG. 5) thus engaging the two and causing the two to remain in the same position at all times.

Figure 6:
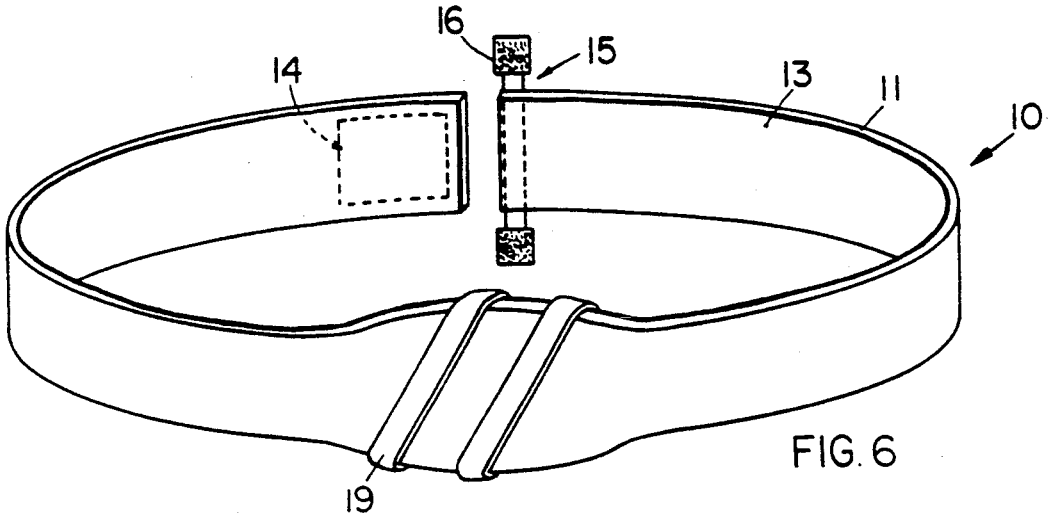
FIG. 6 is a perspective view illustrating the decorative strip variation.
Figure 7:
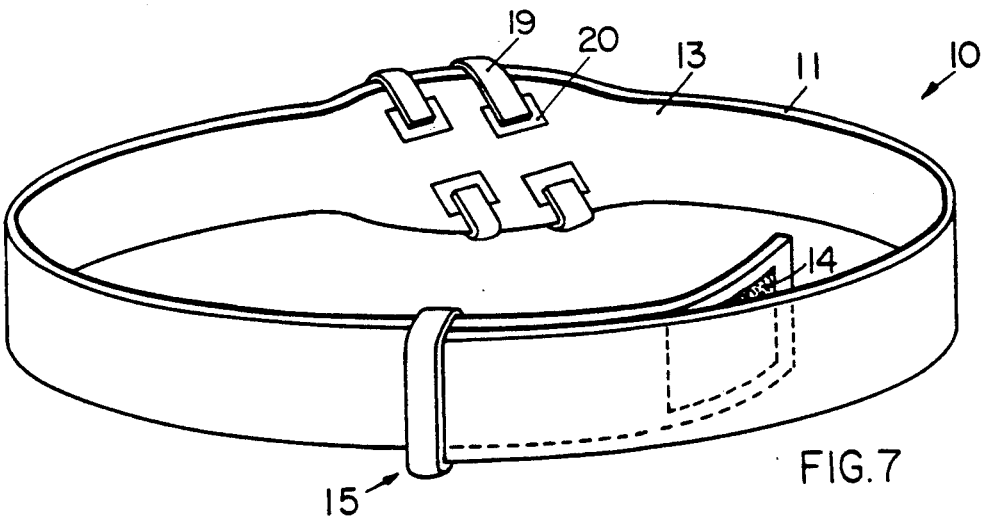
FIG. 7 is a partial perspective view of the back side of the belt of FIG. 6.

In the decorative strip belt variation shown in FIG. 6 and 7, prior to placing the belt on the torso of the wearer, a strip(s) 19 of various shapes, sizes, color or fabric is temporarily fastened, generally at a diagonal position from top to bottom of the belt in the front area, to the inner fabric 13 by the mutually adhesive strips 20 affixed to the back side of the decorative strip ends.

Figure 8:
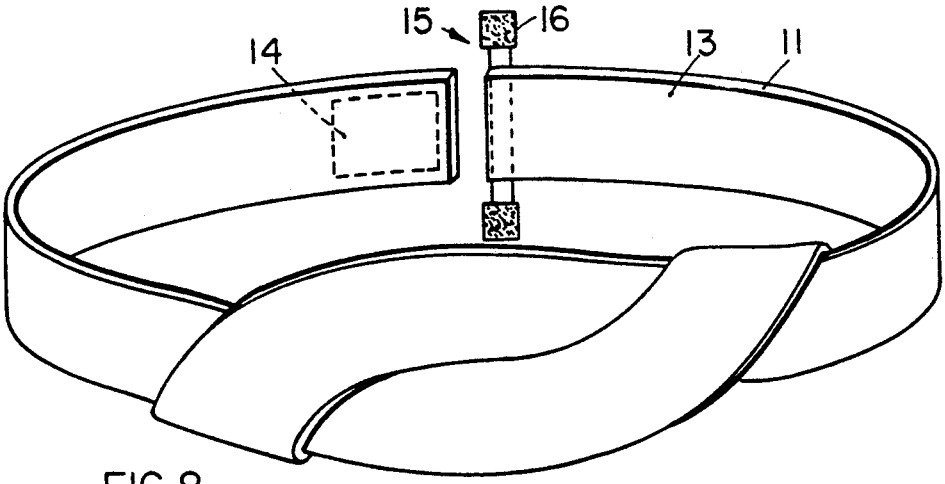
FIG. 8 is a perspective view illustrating the two-part belt variation.
Figure 9:
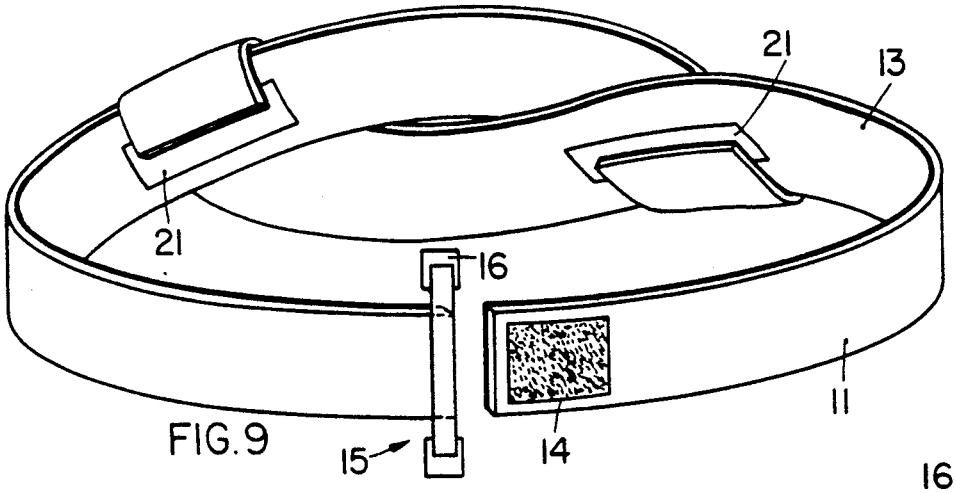
FIG. 9 is a partial perspective view of the back side of the belt of FIG. 8.
Figure 10:
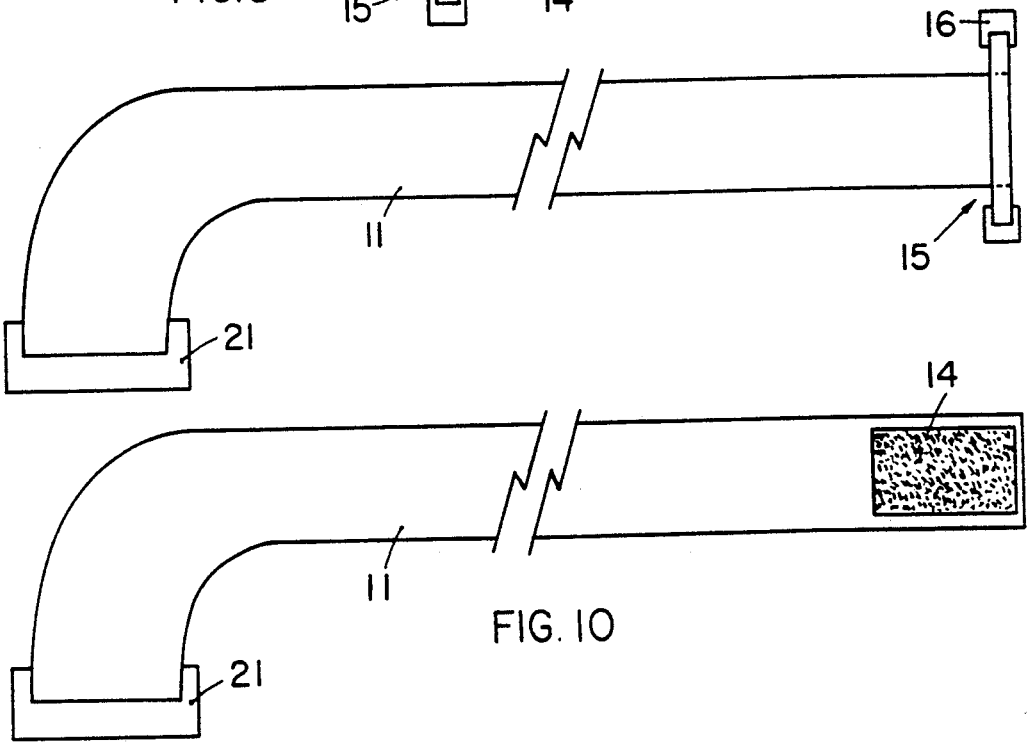
FIG. 10 is a head-on view of the two strips that are used to form the two-part intertwined belt depicted in FIGS. 8 and 9.

In the two-part belt variation shown in FIGS. 8 and 9, prior to placing the belt on the torso of the wearer, the two belt ends are joined by temporarily attaching, the mutually adhesive material 21 securely affixed to the back side 25 of each end to the inner fabric 13 of each strip allowing the wearer to aesthetically pull together a solid different-colored skirt and blouse combination. The purchaser has the opportunity for additional savings simply by purchasing one basic two-piece belt and several different colored belt strips to interlock and form a two-colored belt.

From the description above, a number of advantages of my improved belt invention become evident:

a. with the use of a relatively short strip of mutually adhesive material securely affixed to the center back waistband of garment the belt invention has the capability to remain in the same position on the skirt/slack waistband at all times whether the user be sitting, standing or rising from the sitting position for a truly professionally finished look;

b. the inner fabric of mutually adhesive material allows the belt invention to precisely fit a wide range of circumferences with a mutually adhesive material being applied to only one end of the outer fashion fabric;

c. the inner fabric of mutually adhesive material also gives the belt design the capability of being neatly closed and secured through the use of an opened belt loop thereby making it much easier for the wearer to manipulate;

d. the inner fabric of mutually adhesive material provides an easy economical mechanism via the decorative strip variation and the two-part belt variation for customizing a basic belt to coordinate with a particular garment(s).

SUMMARY, RAMIFICATIONS, AND SCOPE

Accordingly the reader will see that the inner fabric of mutually adhesive material can be utilized to interconnect a belt easily and conveniently. Furthermore, the belt utilizing the inner fabric of mutually adhesive material has the additional advantages in that

- it permits the user to adjust the size of the belt;
- it permits the user to secure the belt to the skirt/slack waistband so that the waistband does not pull down below the belt while sitting or upon standing after sitting;
- it allows the belt to have an easy self-sealing closure;
- it allows great flexibility for the user to immediately change and thereby custom coordinate the belt with different garments; and
- it permits the retail outlet or the customer herself to add a very professional, finished, 'especially for this outfit expensive-look.'

Although the description above contains many specificities, these should not be construed as limiting the scope of the invention but as merely providing illustrations of some of the presently preferred embodiments of this design. For example, the belt itself can have many shapes, such as a simple rectangle, a triangular piece can be added at front; novelty items like shells, etc. can serve as the removable decorative strips; the two-part belt might become a three or four part belt.

Thus the scope of the invention should be determined by the appended claims and their legal equivalents, rather than by the examples given.

While presently preferred embodiments of the invention have been shown and described with particularity, it is understood that various changes and modifications may readily be made without departing from the spirit and scope of the appending claims.

I claim that:

1. A belt of sufficient length to wrap around the torso of the wearer in partially overlapping fashion creating a top belt portion and an underneath belt portion in order to form a continuous band comprising:

a) an outer face of fashion material in any shape and an inner face of mutually adhesive fastening material having the same dimensions as said outer face;

b) a relatively short strip of mutually adhesive fastening material securely affixed to one end of said outer face of fashion material that engages said inner face of said fastening material at any point along the circumference so that an infinitely sized, adjustable, interconnected, continuous band in partially overlapping fashion is formed; and c) a closure means to maintain said top belt portion closely adjacent to said underneath belt portion when said belt is partially overlapped and interconnected.

2. The belt of claim 1 wherein said closure means further comprises mutually adhesive fastening material securely affixed to the backside of two oppositely positioned ends so that said closure means, when folded, forms a C-shaped loop that adheres to said inner face of said mutually adhesive fastening material thereby partially encircling said engaged overlapping belt to maintain said top belt portion closely adjacent to said underneath belt portion.

3. The belt of claim 1 further comprising mutually adhesive fastening material removably secured to the outer, center, back of the waistband of a garment so that said inner face of said belt is removably attached to said garment and said garment is retained in position beneath said belt.

4. The belt of claim 2 further comprising removably attaching, with a relatively short trip of mutually adhesive fastening material, a plurality of interchangeable decorative means of various shapes, colors, sizes and textures coordinated with said garment so that said belt is customized.

5. The belt of claim 2 further comprising dividing said belt into at least two pieces, attaching a relatively short strip of mutually adhesive fastening material to said pieces, and interlocking said pieces thereby.

6. A belt of sufficient length to wrap around the torso of the wearer in partially overlapping fashion creating a top belt portion and an underneath belt portion in order to form a continuous band comprising:

a) an outer face of fashion material in any shape and an inner face of mutually adhesive fastening material having the same dimensions as said outer face;

b) a relatively short strip of mutually adhesive fastening material securely affixed to one end of said outer face of fashion material that engages said inner face of said fastening material at any point along the circumference so that an infinitely sized, adjustable, interconnected, continuous band in partially overlapping fashion is formed;

c) a closure means to maintain said top belt portion closely adjacent to said underneath belt portion when said belt is partially overlapped and interconnected; and d) said closure means further comprising mutually adhesive fastening material securely affixed to the back side of two oppositely positioned ends so that said closure means when folded forms a C-shaped loop that adheres to said inner face of said mutually adhesive fastening material thereby partially encircling said engaged overlapping belt.

7. The belt of claim 6 further comprising mutually adhesive fastening material removably secured to the outer, center, back of the waistband of a garment so that said inner face of said belt is removably attached to said garment and said garment is retained in position beneath said belt.

8. The belt of claim 6 further comprising removably attaching, with a relatively short strip of mutually adhesive fastening material, a plurality of interchangeable decorative means of various shapes, colors, sizes and textures coordinated with said garment so that said belt is customized.

9. The belt of claim 6 further comprising dividing said belt into at least two pieces, attaching a relatively short strip of mutually adhesive fastening material to said pieces, and interlocking said pieces thereby.

* * * * *